US005309068A

United States Patent [19]

Hakkarainen et al.

[11] Patent Number: 5,309,068

[45] Date of Patent: May 3, 1994

[54] TWO RELAY SWITCHING CIRCUIT FOR FLUORESCENT LIGHTING CONTROLLER

[75] Inventors: Simo P. Hakkarainen, Bethlehem; David G. Luchaco, Macungie; Scott McConnell, Coopersburg, all of Pa.

[73] Assignee: Lutron Electronics Co. Inc., Coopersburg, Pa.

[21] Appl. No.: 20,034

[22] Filed: Feb. 19, 1993

[51] Int. Cl.[5] ..... H05B 41/14

[52] U.S. Cl. ..... 315/362; 315/360; 315/226

[58] Field of Search ..... 315/362, 360, 226

[56] References Cited

U.S. PATENT DOCUMENTS 4,349,748 9/1982 Goldstein et al. ..... 315/362

4,709,188 11/1987 Roberts ..... 315/226

*Primary Examiner*—Edward K. Look

*Assistant Examiner*—James A. Larson

*Attorney, Agent, or Firm*—Warren W. Kurz

[57] ABSTRACT

In a fluorescent lighting controller, a switching circuit operates to selectively couple a bank of electronic ballasts to an AC power source (100–277 Volts, 50–60 Hertz). The switching circuit comprises a pair of relays, preferably connected in parallel, with one of such relays having a controllably conductive device, such as an electronic switch, and preferably a triac, connected in series therewith. With the relays open, an air gap isolates the power source and ballasts. In closing the relays in sequence, one relay provides a conductive path from the power source to the triac. After a suitable delay to allow the relay contacts to stabilize in the closed position, the triac is triggered to provide a conductive path from the power source to the ballasts, and a large current surge (as much as 300 amps) flow to the ballasts. After the current surge has subsided, the other relay is closed to provide a direct conductive path between the power source and ballasts. As a result of this arrangement, the switching circuit is low cost, compact and reliable over an extended period of time.

24 Claims, 2 Drawing Sheets

TWO RELAY SWITCHING CIRCUIT FOR FLUORESCENT LIGHTING CONTROLLER

FIELD OF THE INVENTION

The present invention relates to improvements in current-switching circuits of the type used, for example, in fluorescent lighting control systems for selectively connecting a bank of electronic ballasts to an AC power source.

THE TECHNICAL PROBLEM AND PRIOR ART SOLUTIONS

In applying power to an electronic ballast of the type used to control the operation of a fluorescent lamp, one finds that the ballast behaves as a capacitive load. Thus, each time power is applied to the load, for example, by closing a switch between the load and a line voltage source, there is an in-rush of current to the load which quickly subsides as the load charges up to line voltage. This temporary current surge can be problematic as the number of electronic ballasts controlled by a single relay switch increases. For example, in the case of a full 16 ampere (steady-state) circuit of dimming ballasts, the current surge can approach 300 amps. Though short-lived, perhaps only a few cycles, this level of surge can wreak havoc on the contacts of even a relatively large relay having a high (e.g. 50 amp) current rating. The problem stems from the fact that each time a pair of relay contacts close or snap together, there is a tendency for them to bounce apart. When this bouncing occurs during a large current surge, the intervening gas or air ionizes and arcing occurs. The arcing has the effect of blasting away the conductive coatings on the relay contacts which eventually causes the relay to fail, either due to erosion of the contact material, or, more commonly, due to welding of the contacts in the closed position.

To deal with the above problem, one might consider the brute force approach of using a single heavy-duty relay having large contacts and a high spring constant. But relays of this type tend to be both costly and bulky in size. A more elegant and far less costly approach is to use two relatively small relays connected in parallel, with one having a current-limiting resistive element in series therewith. Such a switching circuit is shown in FIG. 1. In operation, relay RL1 is closed for a short time while relay RL2 remains open. As relay RL1 closes, current from the power source rushes through the resistor R to charge up the capacitive load. The amplitude of the current surge is limited by the resistor, depending on its value. After the current surge has abated, the second relay is closed to provide a direct and substantially impedance-free path between the source and load. Obviously, the resistor in this circuit must be appropriately rated to repeatedly tolerate the current surge without damage or breakdown. Such a resistor tends to be relatively large in size and, even compared to some active circuit elements, it's expensive. But more serious problems in adopting the circuit of FIG. 1 are: (1) some arcing will still occur between the relay contacts as they bounce upon initial closure since there is a conductive path through the resistor just as soon as the first relay is closed; and (2) the resistor is repeatedly subjected to high energy stress levels since the voltage across the resistor can approach full line voltage, if only for a short time, each time the first relay is closed. This means the first relay is still subjected to some surge current while still bouncing, and the resistor must dissipate the energy it absorbs as heat, either internally or via a heat sink.

A possible solution to the problems noted above is to employ a hybrid switching circuit of the type which combines a relay of the type having two sets of contacts, and a semiconductor switch, such as a triac. Such a circuit, which is shown in FIG. 2, is available from Aromat Corporation as its Model H-OP10A relay. This circuit operates as follows: When an input signal is applied to the relay, contacts A close first, thereby causing current to immediately flow through resistor R to the gate lead of triac Q. Upon triggering the triac, current flows from the power source to the load, through the triac. After a predetermined time period, the B contacts close, allowing load current to flow unimpeded from the source to the load. At this point, both sets of relay contacts are closed. When the input signal is removed, the B contacts open first, thereby causing load current to again flow in the triac. Subsequently, when contacts A open, the load current becomes zero and is cut off by the triac.

There are at least two potential problems in using a circuit of the type shown in FIG. 2 to control power switching to an electronic ballast. First, since the triac is always driven ON, even when the B contacts are closed, it is possible for load current to continuously flow in the triac, rather than only for the short time interval between the closure of the two sets of contacts. During the initial conduction interval, the triac will reduce the voltage across the still open B contacts to about 1 volt (i.e., the On state voltage of the triac). This low voltage may not be enough to rupture any oxide coating on the second set of contacts; thus, while the B contacts may be mechanically "closed", they may not be "closed" in an electrical sense. The net result will be that all the load current will continue to flow in the triac which, since it is not heat sunk, will rapidly overheat and ultimately fail. Since the typical failure mode is a "short", the relay will then be unable to open the load current.

A second potential problem with the FIG. 2 circuit is that, when the relay is turned OFF, the parallel contacts (i.e., the B contacts) open first, so that the load current is again picked up by the triac momentarily. Later, the drive is removed from the triac gate when the A contacts finally open. At this point, the triac is supposed to commutate OFF, thereby removing power from the load circuit. But certain types of load circuits, particularly those with highly inductive characteristics, can prevent the triac from commutating to the OFF state, thereby leaving the load energized when it is supposed to be OFF. This is a safety issue. Note, there is no air-gap OFF in the FIG. 2 circuit.

SUMMARY OF THE INVENTION

In view of the foregoing discussion, an object of this invention is to provide a power switching circuit which alleviates the aforementioned problems of the prior art.

The switching circuit of the invention basically comprises a pair of relays, preferably connected in parallel, with one of such relays having a controllably conductive device, such as an electronic switch, preferably a triac, in series therewith. With the relays open, an air gap always isolates the power source and load. Since the triac is in series with one of the relays, there is no need to rely on the triac to block the current in the OFF state. Thus, should the triac fail for any reason, the air gap provided by the relays still isolates the load from the power source. In closing the relays in sequence, one relay provides a conductive path from the power source to the triac. After a suitable delay to allow the relay contacts to mechanically stabilize in the closed position, the triac is triggered to provide a conductive path from the power source to the load. After the current surge has subsided, the second relay is closed to provide a direct conductive path between the power source and load. As a result of this arrangement, the switching circuit of the invention is, compared to the prior art discussed above, less costly, more compact, safer to operate and more reliable over an extended operating period.

According to another aspect of the invention, there is provided a method for switching power between an A.C. power source and a load, such method comprising the steps of:

(a) providing a switching circuit comprising first and second switches connected in parallel between the power source and load, such first switch having a controllably conductive device in series therewith;

(b) closing the first switch for a first predetermined time period;

(c) after the first predetermined time period, rendering the controllably conductive device conductive for a second predetermined time period; and (d) thereafter closing the second switch.

The invention and its various advantages will be better understood from the ensuing detailed description of preferred embodiments, reference being made to the accompanying drawings wherein like reference characters designate like parts.

DETAILED DESCRIPTION OF PREFERRED EMBODIMENTS

Figure 2:
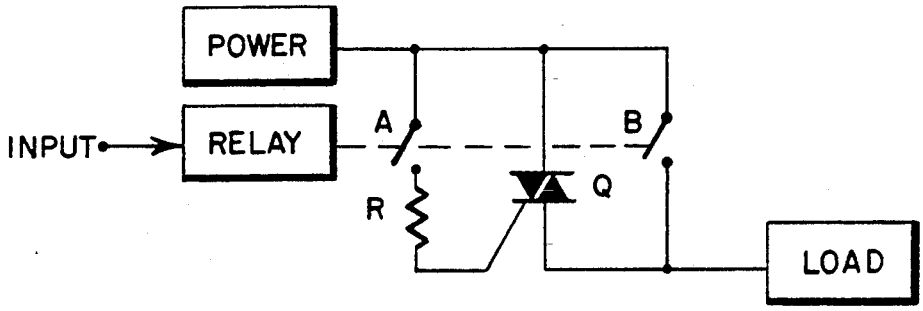
FIG. 2 (PRIOR ART)
Figure 3:
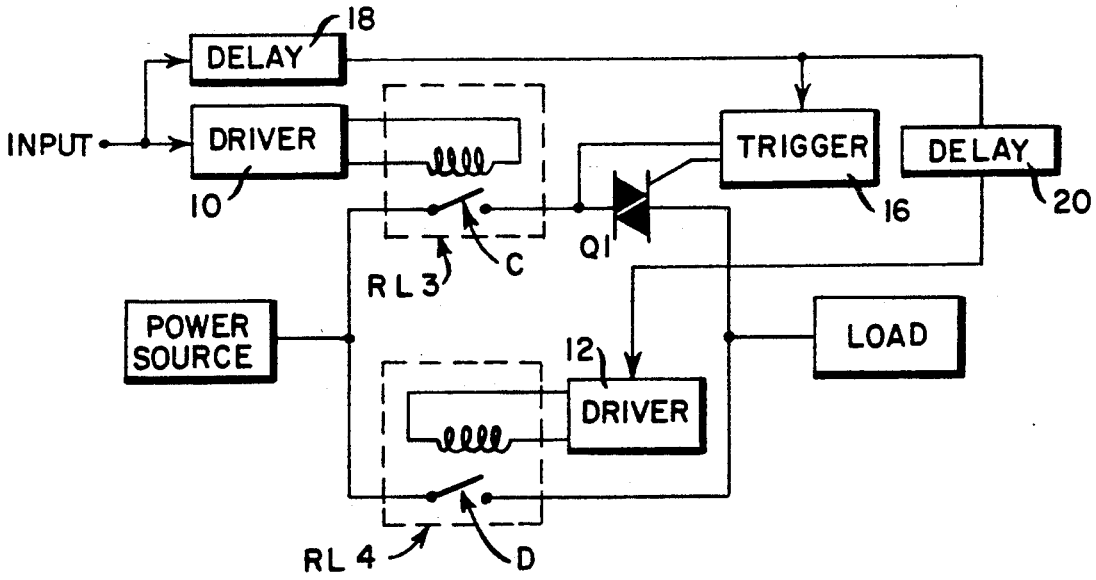
FIGS. 3 and 4 are block diagrams of preferred embodiments of the switching circuit of the invention.

Referring now to FIG. 3, a preferred embodiment of the power switching circuit of the invention is illustrated as comprising a pair of switches, such as discrete relays RL3 and RL4, and a controllably conductive device, such as an electronic switch, and most preferably a triac Q1. While the preferred embodiment utilizes two discrete relays, it will be appreciated that a single relay having two sets of contacts and some means for controlling the relative times at which the contacts close and open could also be used, as in the case of the FIG. 2 switching circuit. Relays RL3 and RL4 are driven by driver circuits 10 and 12, respectively, to cause the respective relay contacts to open and close. The operation of triac Q1 is controlled by a trigger circuit 16 which, at an appropriate time, produces an output on the triac's gate lead, thereby causing the triac to conduct. The FIG. 3 circuit operates as follows:

First, an input is provided to driver circuit 10, thereby causing it to close the contacts C of relay RL3, and allowing current to pass from the power source to the triac. In closing the relay, the contacts will unavoidably "bounce" for a few milliseconds. But since the triac is turned OFF and is designed to block the current during this bounce time, there can be no arcing between the relay contacts as a result of this closure. After a suitable delay (e.g., 10 to 50 msec., and preferably about 25 msec.) sufficient to allow the relay contacts to stabilize in the closed position, the triac is triggered into conduction, and current surges to the load. This delay is provided by a suitable RC delay circuit 18 which is coupled to the input to relay RL3. Since the contacts of relay RL3 are now closed tight, no arcing occurs as a result of any current surge to the load. After a suitable time period to allow the current surge to abate, e.g., 20 to 100 msec. and preferably about 75 msec., the contacts of relay RL4 are closed to provide an impedance-free conduction path from the power source to the load. This delay is provided by a second RC delay circuit 20 which is triggered by the output of circuit 18. At this time, the triac is turned OFF, and relay RL3 is opened to remove the triac from the circuit. By this sequence, the triac need not be heat sunk to dissipate the heat of the steady-state current to the load. To disconnect the load from the power source, relay RL2 is eventually opened.

Figure 1:
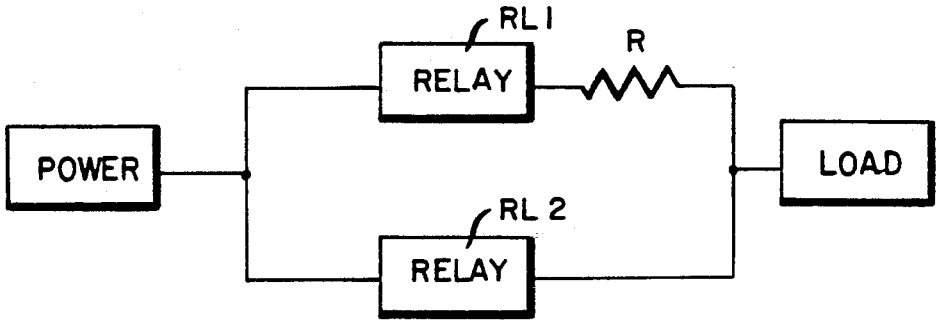
FIG. 1 (PRIOR ART)
FIGS. 1 and 2 are electrical schematics of prior art switching circuits.

Compared to the prior art discussed above, the switching circuit of the invention is advantageous from the following standpoints: (1) It is safe, particularly from the standpoint that an air gap is provided between the load and power source even in the event the triac should fail by shorting out. Note, in the FIG. 2 circuit, failure of the triac results in a direct short between the load and power source. (2) It is highly reliable from the standpoint that the triac only "sees" the load current between the time the triac is fired and the time the second relay (RL4) is closed. (3) There can be no arcing between the relay contacts since the triac is triggered only after the contact "bouncing" has subsided. (4) By virtue of the delay circuits 18 and 20 It is readily adapted for use with different types of relays and triacs. (5) compared to the circuit of FIG. 1, it can be manufactured at lower cost and be made of more compact size.

Figure 4:
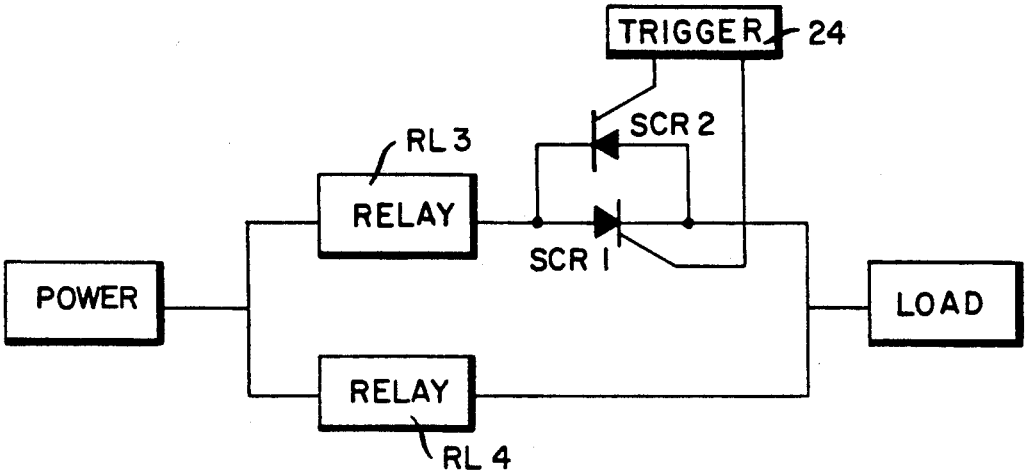

Referring now to FIG. 4, a variation of the FIG. 3 switching circuit is shown to comprise a pair of silicon-controlled rectifiers, SCR-1 and SCR-2, connected in parallel. In combination, these semiconductor switching elements provide substantially the same function as triac Q1 in the FIG. 3 circuit. Their operation is controlled by a conventional trigger circuit 24.

Figure 5:
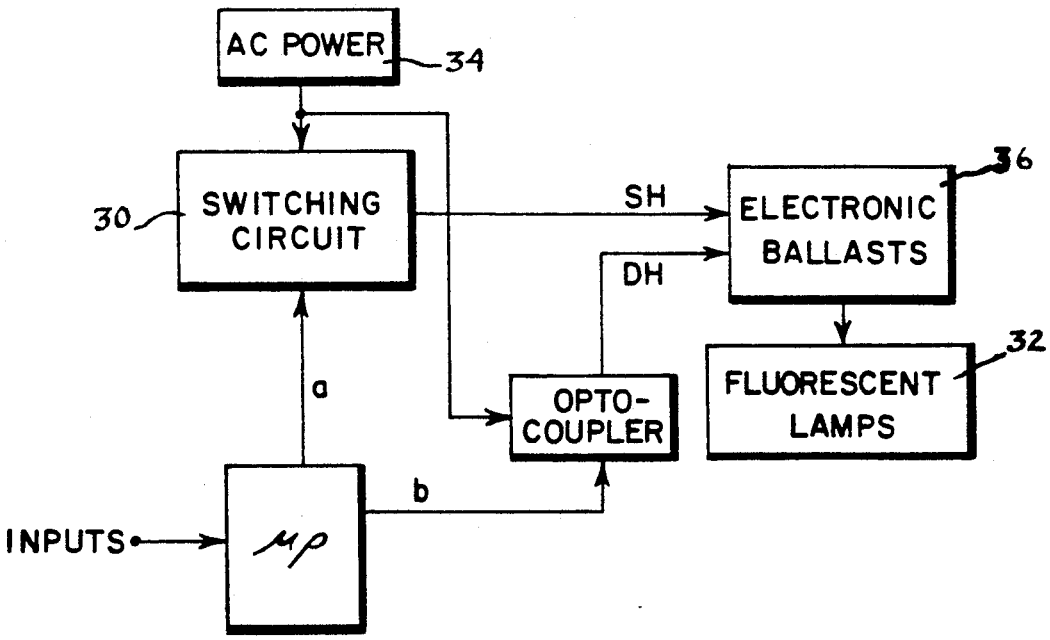
FIG. 5 is a schematic illustration of a fluorescent lighting control system embodying the switching circuit of FIG. 3.

In FIG. 5, the switching circuit 30 of the invention is shown embodied in a microprocessor-based lighting control system of the type which responds to various input signals (e.g., from the light-dimming actuator of a wall box control, a photocell which senses the level of natural lighting, and/or an occupant sensor which senses the presence of a human in a lighting control area) to control the lighting provided by a plurality of fluorescent lamps 32. Based on the level of these inputs, the microprocessor provides an output a which is used as the input to switching circuit 30 to control the switching of power (switched hot SH) between AC power source 34 (e.g., 100–277 volts, 50–60 Hertz) and a bank of electronic ballasts 34, as described above, and an output b which controls the output of an opto-coupler used to provide a high voltage ballast control signal (dimmed hot DH). As noted above, providing switched power to a bank of electronic ballasts can be problematic due to the current surge produced by the impedance characteristics of such a load. The switching circuit of the invention is well adapted to handle this current surge with no adverse effects. A preferred triac for the switching circuit used in the light controller of FIG. 5 is the Model MAC-223-8, made by Motorola, Inc. This triac is preferred due to its high peak surge-current rating.

Since the present invention may be embodied in other specific forms without departing from the spirit or essential attributes thereof, reference should be made to the appended claims, rather than to the foregoing specification, to ascertain the scope of the invention.

What is claimed is:

1. A power-switching circuit for selectively switching power between a power source and a load, said power-switching circuit comprising:

(a) first and third electrically-controllable switches connected in parallel between said power source and load;

(b) a second switch connected in series with said first switch, said second switch being electrically controllable; and (c) means for sequentially closing said first, second and third switches in that order.

2. The apparatus as defined by claim 1 wherein said first and third switches comprise electrical relays.

3. The apparatus as defined by claim 1 wherein said second switch comprises a triac.

4. The apparatus as defined by claim 1 wherein said first and third switches comprise electrical relays, and said second switch comprises a triac.

5. The apparatus as defined by claim 1 wherein said second switch comprises a pair of SCR's connected in parallel.

6. The apparatus as defined by claim 1 wherein said first and third switches are embodied in a single relay.

7. The apparatus as defined by claim 1 further comprising means for controlling the time interval between the sequential closings of said first and second switches.

8. The apparatus as defined by claim 1 further comprising means for controlling the time interval between the sequential closings of said second and third switches.

9. The apparatus as defined by claim 1 further comprising means for controlling the respective time intervals between the sequential closings of said first and second switches, and said second and third switches.

10. A power-switching circuit for selectively switching power between an AC power source and an electronic ballast for a fluorescent lamp, said power-switching circuit comprising:

(a) first and third electrically-controllable switches connected in parallel between said power source and electronic ballast;

(b) a current-limiting second switch connected in series with said first switch, said second switch being electrically controllable; and (c) circuit means for sequentially closing said first, second and third switches in that order.

11. The apparatus as defined by claim 10 wherein said first and third switches comprise electrical relays.

12. The apparatus as defined by claim 10 wherein said second switch comprises a triac.

13. The apparatus as defined by claim 10 wherein said first and third switches comprise electrical relays, and said second switch comprises a triac.

14. The apparatus as defined by claim 10 wherein said second switch comprises a pair of SCR's connected in parallel.

15. The apparatus as defined by claim 10 wherein said first and third switches are embodied in a single relay.

16. The apparatus as defined by claim 10 further comprising means for controlling the time interval between the sequential closings of said first and second switches.

17. The apparatus as defined by claim 10 further comprising means for controlling the time interval between the sequential closings of said second and third switches.

18. The apparatus as defined by claim 10 further comprising means for controlling the respective time intervals between the sequential closings of said first and second switches, and said second and third switches.

19. A method for switching power between an A.C. power source and a load, said method comprising the steps of:

(a) providing a switching circuit comprising first and second switches connected in parallel between the power source and load, said first switch having a controllably conductive device in series therewith;

(b) closing said first switch for a first predetermined time period;

(c) after said first predetermined time period, rendering said controllably conductive device conductive for a second predetermined time period; and (d) thereafter closing said second switch.

20. The method as defined by claim 19 further comprising the step of opening said first switch and rendering said controllably conductive device non-conductive after closure of said second switch.

21. The method as defined by claim 20 wherein said first predetermined period is between about 10 and about 50 milliseconds, and wherein said second predetermined time period is between about 20 and about 100 milliseconds.

22. The method as defined by claim 21 wherein said first and second predetermined time periods are about 25 and about 75 milliseconds, respectively.

23. The method as defined by claim 19 wherein said first and second switches comprise electrical relays, each relay having electrical contacts which snap together when their associated switch is closed, and wherein said first time period is sufficient to allow the contacts of said first switch to stabilize together after said first switch is closed.

24. The method as defined by claim 23 wherein said second predetermined time period is sufficient to allow any current surge occurring after said controllably conductive device is rendered conductive to abate.

* * * * *